US007071459B2

(12) United States Patent
Pustelniak

(10) Patent No.: US 7,071,459 B2
(45) Date of Patent: Jul. 4, 2006

(54) INTERFERENCE COMPENSATION OPTICALLY SYNCHRONIZED SAFETY DETECTION SYSTEM FOR ELEVATOR SLIDING DOORS

(75) Inventor: Richard Pustelniak, Tucson, AZ (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 10/537,216

(22) PCT Filed: Dec. 31, 2002

(86) PCT No.: PCT/US02/41816

§ 371 (c)(1),
(2), (4) Date: Jun. 3, 2005

(87) PCT Pub. No.: WO2004/059692

PCT Pub. Date: Jul. 15, 2004

(65) Prior Publication Data

US 2006/0033013 A1 Feb. 16, 2006

(51) Int. Cl.
*H01J 40/14* (2006.01)
*E05F 15/20* (2006.01)

(52) U.S. Cl. ..... 250/221; 250/341.7; 49/26; 340/545.3

(58) Field of Classification Search ..... 250/221, 250/222.1, 341.7, 214 AL, 214 B; 340/555–557, 340/545.3; 49/25, 26, 28; 187/317; 318/480
See application file for complete search history.

(56) References Cited

U.S. PATENT DOCUMENTS 4,823,010 A 4/1989 Kornbrekke et al.
4,967,083 A * 10/1990 Kornbrekke et al. ..... 250/341.7
5,641,951 A * 6/1997 Cai et al. ..... 187/317

* cited by examiner

*Primary Examiner*—Kevin Pyo
(74) *Attorney, Agent, or Firm*—Bachman & LaPointe, P.C.

(57) ABSTRACT

A method for detecting interference energy in a sliding door safety system includes the steps of disposing at least one emitter along a first vertical surface, disposing at least one receiver corresponding to the at least one emitter along a second vertical surface, activating the at least one receiver, activating the at least one emitter to emit an energy beam that includes a modulated square wave of a predetermined frequency, sampling an energy intensity received by the activated at least one receiver a predetermined number of times recording each time a received energy intensity to form a plurality of recorded energy intensities, selecting the lowest magnitude one of the plurality of recorded energy intensities to form a lowest recorded energy intensity, comparing the lowest recorded energy intensity to a threshold value and determining a source of the energy intensity to be external when the lowest recorded energy intensity is less than the threshold value.

7 Claims, 2 Drawing Sheets

INTERFERENCE COMPENSATION OPTICALLY SYNCHRONIZED SAFETY DETECTION SYSTEM FOR ELEVATOR SLIDING DOORS

BACKGROUND OF THE INVENTION (1) Field of the Invention

The present invention relates to a method for detecting energy interference in an optically synchronized safety detection system for sliding elevator doors and compensating for such interference.

(2) Description of Related Art

In optically synchronized elevator detection and safety systems, consisting of separate emitter and receiver arrays, the energy produced by an emitter array is produced in a fixed sequence or pattern, and the receiver array predictively enables or activates individual receivers according to the fixed sequence produced by the emitters. When an activated receiver detects sufficient energy from the emitter array, a "connect" is logged for the individual beam being sampled (composed of the specific emitter and its corresponding receiver). The receiver array then disables the currently enabled receiver and activates the next receiver in the scanning sequence. This process continues as long as beams connect. Broken beams (those for which an individual receiver does not detect emitted energy within a specified maximum wait time) cause the detection system to signal a door controller to reopen the doors due to the detection of an obstruction in the path of the closing doors.

A drawback of one such optically synchronized detection system is the potential presence of various external sources of light energy or electrical noise which can interfere with the optical and synchronization, or sync, functionality of the scan. If the energy produced by these external sources is modulated similarly to the energy transmitted by the door safety system, the external energy can be received by the system and interpreted as detection scanning beam energy produced by the emitter array and cause false indexing of receivers to check the next beam in the scan sequence.

Such false indexing causes loss of sync between the emitter array and the receiver array, resulting in false obstruction detections and false reversals of the elevator doors. Sources of interference light energy include fluorescent lighting systems, strobe lights associated with fire alarm systems, and beacons atop emergency vehicles. Sources of external, impulse type, electrical noise include relay type elevator controllers and electromechanical door operators.

What is therefore needed is a safety detection system for sliding doors which ensures proper operation of in the presence of impulse type electrical noise and light sources, which produce light similar to that produced by the safety detection system for scanning purposes.

SUMMARY OF THE INVENTION

Accordingly, it is an object of the present invention to provide a method for detecting energy interference in an optically synchronized safety detection system for sliding elevator doors and compensating for such interference.

In accordance with the present invention, a method for detecting interference energy in a sliding door safety system comprises the steps of disposing at least one emitter along a first vertical surface, disposing at least one receiver corresponding to the at least one emitter along a second vertical surface, activating the at least one receiver, activating the at least one emitter to emit an energy beam comprising a modulated square wave of a predetermined frequency, sampling an energy intensity received by the activated at least one receiver a predetermined number of times recording each time a received energy intensity to form a plurality of recorded energy intensities, selecting the lowest magnitude one of the plurality of recorded energy intensities to form a lowest recorded energy intensity, comparing the lowest recorded energy intensity to a threshold value and determining a source of the energy intensity to be external when the lowest recorded energy intensity is less than the threshold value.

In accordance with the present invention, the aforementioned method additionally comprises the steps of performing statistical analysis upon the plurality of recorded received energy intensities to determine a measure of consistency amongst the plurality of recorded received energy intensities when the source of the energy intensity has not previously been determined to be external, and determining a source of the energy intensity to be external if the measure of consistency is sufficiently low.

In accordance with the present invention, the aforementioned method additionally comprises the additional steps of modulating the energy beam with a predefined binary code, sampling an energy signal received by the activated at least one receiver a predetermined number of times recording each time a received energy signal to form a plurality of recorded energy signals, and verifying the presence of the predefined binary code in at least one of the sampled plurality of recorded energy signals.

DETAILED DESCRIPTION OF THE PREFERRED EMBODIMENT(S)

Figure 1:
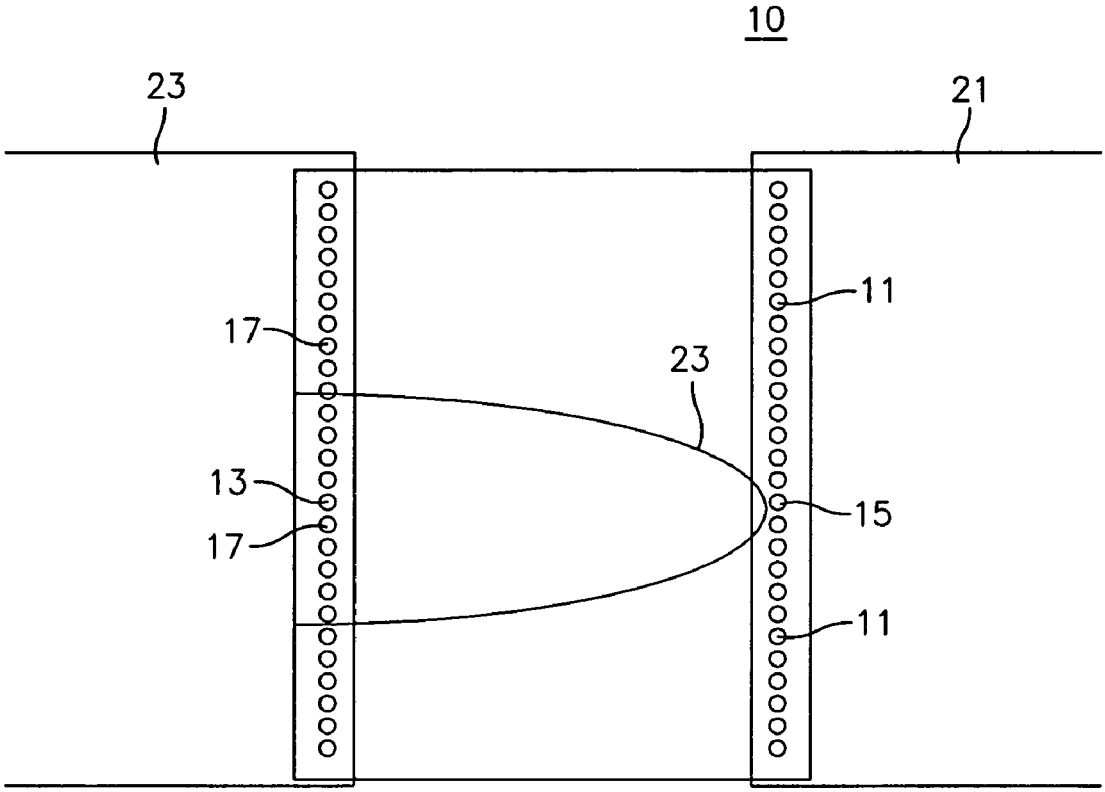
FIG. 1 A diagram of an elevator sliding door system to which the present invention is directed.

With reference to FIG. 1 there is illustrated a vertically arranged array of emitters 11 located along the right door 21 of an elevator sliding door system 10 and a matched, vertically arranged, array of receivers 17 located along the left door 23 of an elevator sliding door system 10. While illustrated with reference to a plurality of emitters 11 and receivers 17 arranged vertically and programmed to emit and receive a plurality of energy beams in a predefined sequence, the present invention is not so limited. Rather, the present invention is broadly drawn to encompass any and all configurations of emitters and receivers arranged to perform a safety scan in an environment wherein spurious, external, electromagnetic signals may interfere with emitted energy beams.

A representation of the energy beam 23 produced by a single active emitter 15 is shown. In a preferred embodiment, the energy beam 23 comprises IR energy. A single active emitter 15 is turned on and a receiver 17 directly across from the emitter is activated to form an active receiver 13 is turned on and remains on until it detects the energy beam's 23 signal. After detecting the energy beam 23, the active receiver 13 is disabled and the next receiver 17 in the scan sequence in activated to become the active receiver 13 and to receive the energy beam 23.

When the next emitter 11 in the sequence is turned on to become the active emitter 15, and the light path to the active receiver 13 is not blocked, the received energy beam 23 signal triggers the next receiver 17 in the sequence to be activated, and so on. This pattern repeats for each emitter/receiver pair.

With the present invention, as the area in the path of the closing doors is scanned for obstructions, techniques are applied which enable the safety system to discriminate between the pickup of energy produced by the safety system to detect objects in the entryway, and energy produced by some external source.

In a preferred embodiment of the present invention, each beam is sampled multiple times in each door scan frame. The sampling is accomplished by modulating the energy transmitted with a continuous stream of square waves, at a specified frequency. Each beam is sampled successively up to a pre-set maximum number of times. The value of the smallest amplitude sample so acquired is the value actually stored and used as the beam intensity for that beam. If, at any time, during the sampling of a particular beam, no energy is detected, the beam intensity is set to zero. After sampling the pre-set number of times, the stored beam intensity is compared to a predetermined threshold value. If the stored beam intensity is less than the predetermined threshold value, the presence of impulse type energy from an external source is confirmed. This is possible because impulse energy is out of phase with the frequency at which the sampling is performed. As a result, over a number of samples, at least one sample resulting from impulse energy will exhibit a low magnitude. In this way, impulse type energy from external sources can be quickly and easily ignored.

Figure 2:
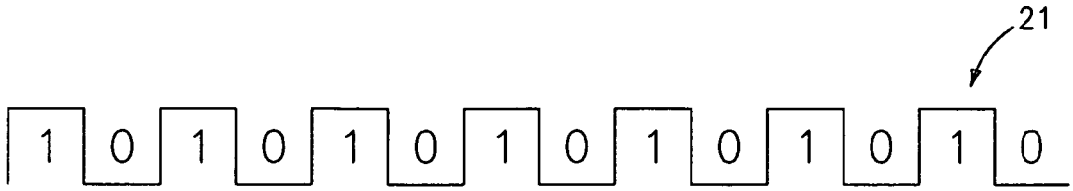
FIG. 2 A diagram of a modulated square wave for use in the elevator sliding door system of the present invention.

In an alternate embodiment of the present invention, each beam is sampled multiple times in each door scan frame. The sampling is accomplished by modulating the energy transmitted with a continuous stream of square waves 21 at a specified frequency as illustrated in FIG. 2. Multiple sampling and impulse rejections are performed as described for the simplest embodiment above. However, if no sample for a particular beam results in a determination that the energy received originated external to the detection system, the resulting energy samples acquired for that beam are compared to determine if the detected energy represents the pickup of external energy or actual scanning energy being produced by the detection system.

If the amplitude of the received energy is not consistent, from sample to sample, the determination is made that the received energy originated external to the safety system and is rejected. If the amplitude of the energy is consistent, from sample to sample, the determination is made that the energy was actually scanning energy produced by the detection system. In a preferred embodiment, a maximum amplitude deviation amongst all of the samples is computed and analyzed to determine if the samples, taken as a whole, are sufficiently consistent to confirm that the received energy came from the detection system. However, any number of forms of statistical analysis may be performed to determine the consistency of the samples.

Figure 3:
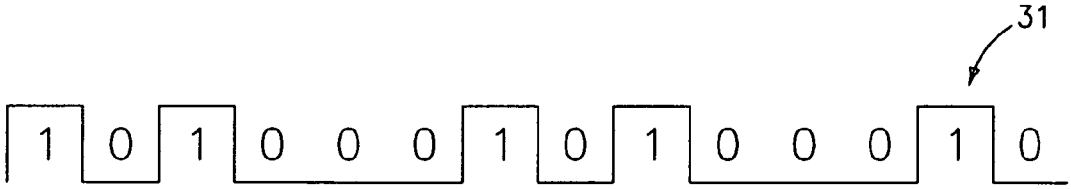
FIG. 3 A diagram of a modulated binary code square wave for use in the elevator sliding door system of the present invention.

In yet another alternative embodiment of the present invention, each beam is sampled multiple times in each door scan frame. The sampling is accomplished by modulating the energy transmitted with a specific binary code 31 as illustrated in FIG. 3. As each sample is being acquired, and while the amplitude of the sample is being measured, the binary code expected to be modulating the received signal is verified. Multiple sampling and impulse rejections are performed, just as described above. However, if no sample for a particular beam results in a "no detect", the resulting energy samples for that beam, are compared to determine if the detected energy represents the pickup of external energy or actual scanning energy being produced by the detection system. If the amplitude of the received energy is not consistent, from sample to sample, or the binary modulation code is not verified, the determination is made that the received energy originated external to the safety system and is rejected. If the amplitude of the energy is consistent, from sample to sample, or the binary modulation code is verified, the determination is made that the energy was actually scanning energy produced by the detection system.

It is apparent that there has been provided in accordance with the present invention an optically synchronized safety detection system for sliding elevator doors capable of compensating for interference which fully satisfies the objects, means, and advantages set forth previously herein. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A method for detecting interference energy in a sliding door safety system comprising the steps of:

disposing at least one emitter along a first vertical surface;

disposing at least one receiver corresponding to said at least one emitter along a second vertical surface;

activating said at least one receiver;

activating said at least one emitter to emit an energy beam comprising a modulated square wave of a predetermined frequency;

sampling an energy intensity received by said activated at least one receiver a predetermined number of times recording each time a received energy intensity to form a plurality of recorded energy intensities;

selecting the lowest magnitude one of said plurality of recorded energy intensities to form a lowest recorded energy intensity;

comparing said lowest recorded energy intensity to a threshold value; and determining a source of said energy intensity to be external when said lowest recorded energy intensity is less than said threshold value.

2. The method of claim 1 comprising the additional steps of:

performing statistical analysis upon said plurality of recorded received energy intensities to determine a measure of consistency amongst said plurality of recorded received energy intensities when said source of said energy intensity has not previously been determined to be external; and determining a source of said energy intensity to be external if said measure of consistency is sufficiently low.

3. The method of claim 2 comprising the additional step of modulating the energy beam with a predefined binary code.

4. The method of claim 3 comprising the additional step of:

sampling an energy signal received by said activated at least one receiver a predetermined number of times recording each time a received energy signal to form a plurality of recorded energy signals; and verifying the presence of said predefined binary code in at least one of the sampled plurality of recorded energy signals.

5. The method of claim 1 wherein disposing said at least one emitter along a first vertical surface comprises disposing said at least one emitter along an elevator door.

6. The method of claim 1 wherein disposing said at least one receiver corresponding to said at least one emitter along a second vertical surface comprises disposing said at least one receiver along an elevator door.

7. The method of claim 1 wherein said energy beam comprises IR energy.

* * * * *